US010731335B2

(12) United States Patent
Baltz, Jr. et al.

(10) Patent No.: US 10,731,335 B2
(45) Date of Patent: Aug. 4, 2020

(54) TOP OF WALL VENTILATION SCREED DEVICE AND ASSEMBLY

(71) Applicant: Alabama Metal Industries Corporation, Birmingham, AL (US)

(72) Inventors: Gary George Baltz, Jr., Mountain Brook, AL (US); Frederic C. Mayer, Jr., Hoover, AL (US)

(73) Assignee: ALABAMA METAL INDUSTRIES CORPORATION

( * ) Notice: Subject to any disclaimer, the term of this patent is extended or adjusted under 35 U.S.C. 154(b) by 0 days.

(21) Appl. No.: 16/509,181

(22) Filed: Jul. 11, 2019

(65) Prior Publication Data

US 2020/0063432 A1 Feb. 27, 2020

Related U.S. Application Data

(60) Provisional application No. 62/714,361, filed on Aug. 3, 2018.

(51) Int. Cl.

| | |
|---|---|
| ***E04B 1/70*** | (2006.01) |
| ***E04F 13/06*** | (2006.01) |
| ***E04F 13/00*** | (2006.01) |

(52) U.S. Cl.

CPC ..... *E04B 1/7076* (2013.01); *E04B 1/7038* (2013.01); *E04F 13/007* (2013.01); *E04F 13/06* (2013.01)

(58) Field of Classification Search

CPC .... E04B 1/7076; E04B 1/7046; E04B 1/7038; E04B 1/70; E04B 1/765; E04F 13/007;

(Continued)

(56) References Cited

U.S. PATENT DOCUMENTS 1,676,582 A * 7/1928 Stuart ..... E04F 13/06 52/27
2,245,965 A * 6/1941 Hyman ..... E04B 1/7046 52/215

(Continued)

FOREIGN PATENT DOCUMENTS

AU 2008202082 A1 11/2008
CA 2777166 A1 11/2012

(Continued)

OTHER PUBLICATIONS

From U.S. Appl. No. 15/446,732—cited as "Prior Art Weep Screed from Google Search 1 page: dated 2004".

(Continued)

*Primary Examiner* — Jessie T Fonseca
(74) *Attorney, Agent, or Firm* — Jennifer Meredith, Esq.; Lippes Mathias Wexler Friedman LLP

(57) ABSTRACT

A ventilation screed comprising a perforated attachment flange portion that is substantially vertical and at least one perforation between the top end and the bottom end; a first substantially horizontal flange portion attached to the top end of the perforated attachment flange at the first end; a first vertical flange portion attached at a point along a mid-section to the second end of the first substantially horizontal flange portion and having a first return leg; a second vertical flange portion attached to the underside of the first substantially horizontal flange portion along a mid-section and having a second return leg; a stepped flange portion attached to the top end of the first vertical flange portion; at least two drain vent openings in the first substantially horizontal flange portion between the first return leg and the second return leg.

19 Claims, 8 Drawing Sheets

(58) Field of Classification Search
CPC . E04F 17/04; E04F 19/02; E04F 19/04; E04F 13/06; E04F 2013/065; E04F 2019/0445
See application file for complete search history.

(56) References Cited

U.S. PATENT DOCUMENTS

| | | | | |
|---|---|---|---|---|
| 2,645,824 | A | 7/1953 | Titsworth | |
| 3,206,806 | A | 9/1965 | Powell | |
| 3,343,323 | A * | 9/1967 | Mayfield | E04B 1/7076 52/302.3 |
| 3,568,391 | A | 3/1971 | Conway | |
| 4,924,647 | A | 5/1990 | Drucker | |
| 5,630,297 | A | 5/1997 | Rutherford | |
| 5,694,723 | A | 12/1997 | Parker | |
| 5,809,731 | A | 9/1998 | Reiss | |
| 5,836,135 | A | 11/1998 | Hagan | |
| 5,950,385 | A * | 9/1999 | Herren | E04B 2/7453 52/479 |
| 6,018,924 | A | 2/2000 | Tamlyn | |
| 6,119,429 | A | 9/2000 | Bifano | |
| 6,293,064 | B1 | 9/2001 | Larson | |
| 6,298,609 | B1 | 10/2001 | Bifano | |
| 6,308,470 | B1 | 10/2001 | Durkovic | |
| 6,385,932 | B1 | 5/2002 | Melchiori | |
| 6,410,118 | B1 | 6/2002 | Reicherts | |
| 6,470,638 | B1 | 10/2002 | Larson | |
| 6,792,725 | B1 | 9/2004 | Rutherford | |
| 6,823,633 | B2 | 11/2004 | Ryan | |
| 6,988,345 | B1 * | 1/2006 | Pelfrey | E04F 13/0864 52/519 |
| 7,219,477 | B2 | 5/2007 | Leffler | |
| 7,487,623 | B2 * | 2/2009 | Rodolofo | E04D 13/152 52/288.1 |
| 7,546,719 | B1 | 6/2009 | Guevara | |
| 7,584,587 | B2 | 9/2009 | Ouellette | |
| 7,621,079 | B2 | 11/2009 | Kyozaburo | |
| 7,634,883 | B1 * | 12/2009 | Larson | E04F 13/06 52/393 |
| 7,743,575 | B2 | 6/2010 | Ito | |
| 7,810,291 | B2 | 10/2010 | McPherson | |
| 8,281,530 | B2 | 10/2012 | Chaussee | |
| 8,578,660 | B2 | 11/2013 | Nolan | |
| 8,596,019 | B2 | 12/2013 | Aitken | |
| 8,646,222 | B2 | 2/2014 | Carbonaro | |
| D700,717 | S | 3/2014 | Campacci | |
| 8,726,594 | B2 | 5/2014 | Salazar | |
| 8,813,443 | B2 | 8/2014 | Goldberg | |
| 8,919,062 | B1 | 12/2014 | Viness | |
| 8,943,761 | B2 | 2/2015 | Carbonaro | |
| 9,140,008 | B2 | 9/2015 | Fischer | |
| 9,366,040 | B2 | 6/2016 | Singh | |
| D792,609 | S * | 7/2017 | Smith | D25/119 |
| 2003/0126810 | A1 | 7/2003 | Brunson | |
| 2003/0177736 | A1 | 9/2003 | Gatherum | |
| 2006/0123723 | A1 | 6/2006 | Weir | |
| 2006/0277854 | A1 | 12/2006 | Egan | |
| 2007/0044402 | A1 | 3/2007 | Hess | |
| 2007/0130861 | A1 * | 6/2007 | Chenier | E04F 13/06 52/371 |
| 2007/0256386 | A1 * | 11/2007 | Ito | E04F 13/0889 52/582.1 |
| 2008/0104918 | A1 * | 5/2008 | Gleeson | E04B 1/74 52/489.1 |
| 2009/0173858 | A1 * | 7/2009 | LaCerte | E04B 2/721 248/231.91 |
| 2009/0183453 | A1 | 7/2009 | Koessler | |
| 2010/0101168 | A1 | 4/2010 | Hohmann | |
| 2010/0287861 | A1 | 11/2010 | Goldberg | |
| 2011/0252731 | A1 | 10/2011 | Boyer | |
| 2011/0302863 | A1 | 12/2011 | Sourlis | |
| 2012/0066984 | A1 | 3/2012 | Thompson | |
| 2012/0066986 | A1 | 3/2012 | Thompson | |
| 2013/0125487 | A1 | 5/2013 | Power | |
| 2015/0013257 | A1 | 1/2015 | Power | |
| 2015/0027074 | A1 | 1/2015 | Preston | |
| 2016/0069071 | A1 * | 3/2016 | Remmele | E04F 13/068 52/232 |
| 2016/0340908 | A1 * | 11/2016 | Apanovich | E04F 13/068 |
| 2017/0030072 | A1 | 2/2017 | Corson | |
| 2017/0226732 | A1 | 8/2017 | Collins | |
| 2017/0254091 | A1 | 9/2017 | Friel | |
| 2018/0305921 | A1 * | 10/2018 | Margalit | E04B 1/7038 |
| 2019/0368190 | A1 * | 12/2019 | Stender | E04B 1/665 |

FOREIGN PATENT DOCUMENTS

| | | | | |
|---|---|---|---|---|
| CA | 2983532 | A1 * | 4/2018 | E04F 13/045 |
| JP | 2657037 | B2 | 9/1997 | |
| JP | 10037321 | | 2/1998 | |
| JP | 11131611 | A | 5/1999 | |
| JP | 2008196248 | | 8/2008 | |
| JP | 4490340 | B2 | 6/2010 | |
| JP | 5968618 | | 8/2010 | |
| JP | 2011169094 | A | 9/2011 | |
| JP | 5002275 | | 8/2012 | |
| JP | 2012202177 | | 10/2012 | |
| JP | 2014218814 | | 11/2014 | |
| WO | WO2016040273 | | 3/2016 | |

OTHER PUBLICATIONS

From U.S. Appl. No. 15/446,732—cited as "Images of J-Bead believed to have been known in the art prior to Mar. 1, 2016".

* cited by examiner

TOP OF WALL VENTILATION SCREED DEVICE AND ASSEMBLY

This application claims priority to provisional patent application No. 62/714,361 filed Aug. 3, 2018 which is incorporated herein by reference. The present disclosure generally relates to a device configured to allow ventilation and the escape of water or other moisture, typically in the form of vapor at the top of a building or wall structure.

TECHNICAL FIELD

Background

For purposes of the foregoing specification and appended claims the term "vapor," whether or not accompanied by any words such as "moisture," "water" or other words describing similar matter or states of matter, refers to all forms of liquid and gases not limited to water, water vapor, moisture as created by any means.

This invention addresses the condition that walls hold vapor and moisture and their inability to allow vapor and moisture to escape so the wall can dry is a major factor in the premature deterioration of a structure. Building science, construction practices and emerging energy codes have changed greatly over recent decades resulting in significantly better insulated walls. Consequently these newer wall designs allow less means for vapor and moisture to escape and less air flow. This has led to increasingly premature deterioration of walls of buildings and structures.

Established wall designs and construction are intended to keep water out of walls but not necessarily to allow them to breathe. Building wraps traditionally prevent water intrusion but do not let moisture out. A better wall design must allow for moisture and vapor to move through a predetermined path depending upon when the inside and outside temperatures have the sufficient temperature difference to create and hold excess moisture.

Further, air pressure differential from inside and outside the wall due to temperature and or wind can force moisture into the wall through the wall's surface, in addition preventing vapor and moisture from escaping. This prevents condensation from escaping and inhibits drying. Further, when cold air contacts hot air, or vice versa, condensation occurs and moisture is formed inside the walls of buildings and structures.

As a result, moisture and water accumulates without a means to escape causing the sheathing of walls to absorb moisture. Plywood, cement board, or OSB (Oriented Strand Board), which is more prone to absorb moisture can begin to mold, deteriorate, rot and hold more water. As the sheathing fails the weight of the finish material will begin to crack. This allows more moisture accumulation in the walls. Ultimately the finish material can fall away from the building or structure. Areas receiving 20-inches or more of rain a year are the most susceptible to this type of deterioration.

Designs currently available use casing beads for the top of walls of a structure or a building. The current art does not facilitate the ventilation of a primary drainage cavity or the drying of the inside of the wall. Some of these areas of concern are at the top of full height walls and step walls, changes in roofline where a vertical element terminates into a non-vertical structure such as a dormer and roof for the removal of vapor from the top of the wall. In areas as noted above where greater rainfall is typical a more defined escape means for vapor and moisture is required over current methods.

Current commercially available accessories for stucco, stone and other finishes do not address these conditions and constraints on air and vapor flow throughout a wall. Therefore the present invention is necessary to accommodate the different forms and function of the building envelope and prevent premature deterioration of the walls.

SUMMARY OF THE INVENTION

In one embodiment, a ventilation screed is provided comprising: a perforated attachment flange portion that is substantially vertical and has a top end and a bottom end and at least one perforation between the top end and the bottom end; a first substantially horizontal flange portion having a first end and a second end and attached to the top end of the perforated attachment flange at the first end; a first vertical flange portion having a top end, a bottom end and a mid-section and attached at a point along a mid-section to the second end of the first substantially horizontal flange portion and having a first return leg; a second vertical flange portion attached to the underside of the first substantially horizontal flange portion along a mid-section and having a second return leg; a stepped flange portion attached to the top end of the first vertical flange portion and having a first substantially horizontal portion, a substantially vertical portion and a second substantially horizontal portion that is parallel to first substantially horizontal flange portion; at least two drain vent openings in the first substantially horizontal flange portion between the first return leg and the second return leg.

BRIEF DESCRIPTION OF THE DRAWINGS

In the following section, the present disclosure will be described with reference to exemplary embodiments illustrated in the figures, in which.

DETAILED DESCRIPTION

Figure 1:
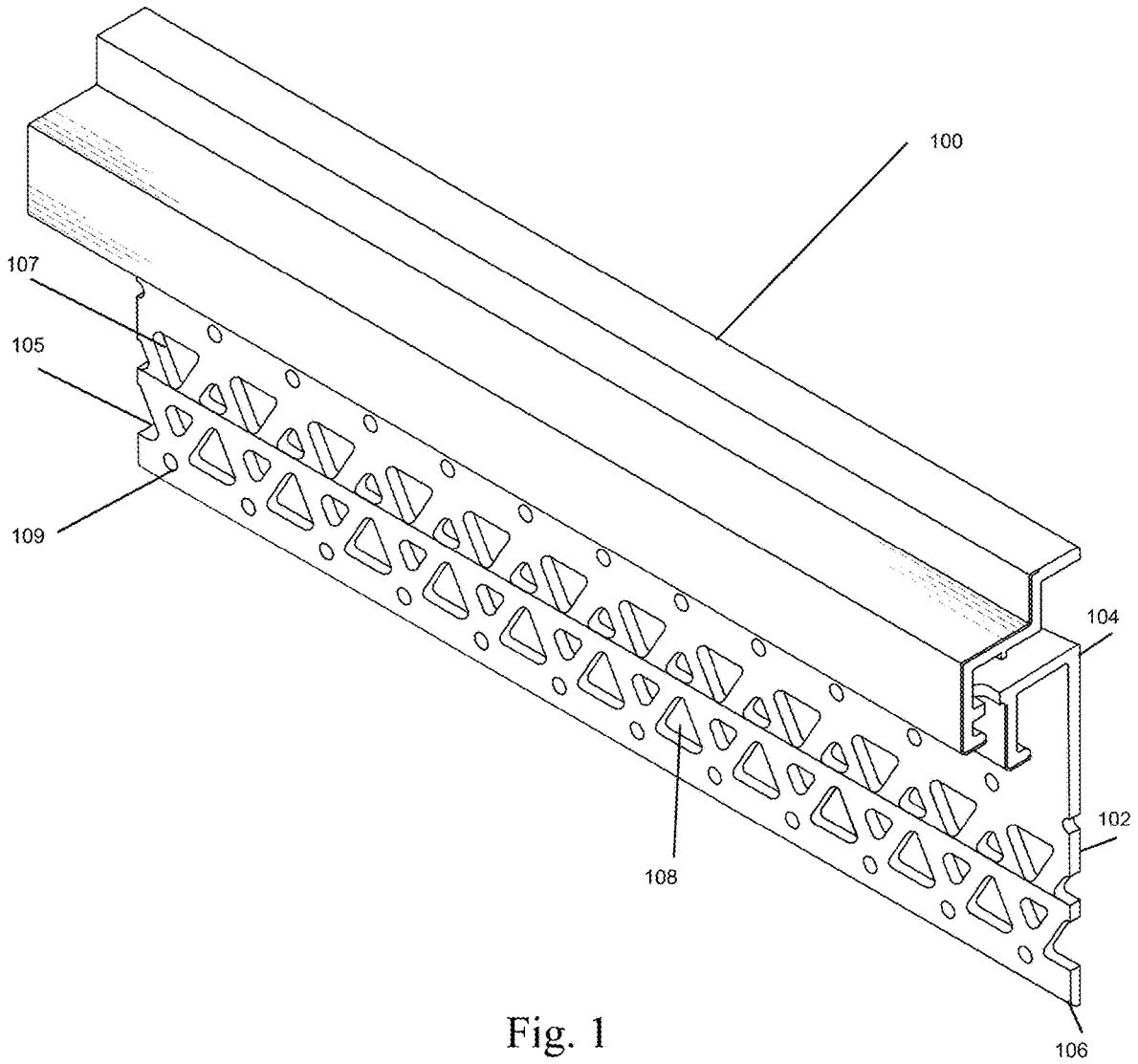
FIG. 1 depicts the present invention.
Figure 2:
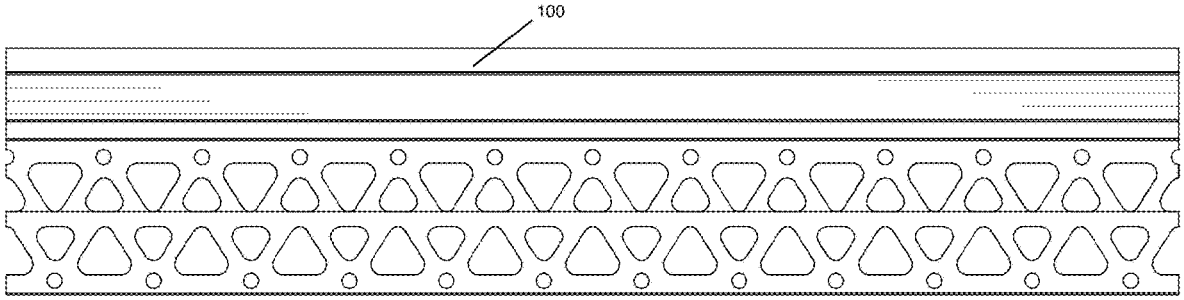
FIG. 2 depicts a front view of the present invention.
Figure 3:
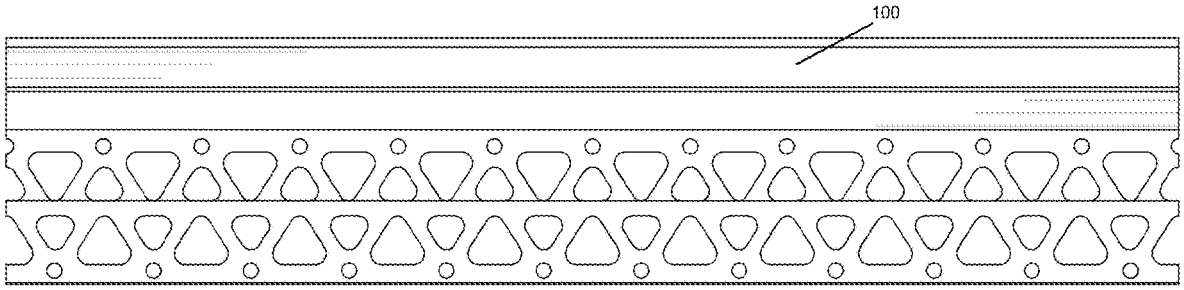
FIG. 3 depicts a back view of the present invention.
Figure 4:
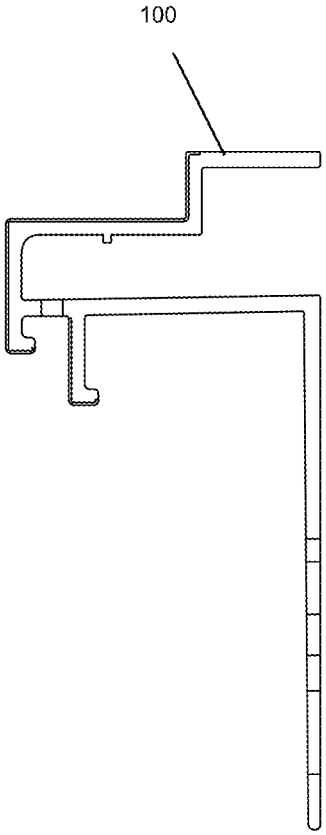
FIG. 4 depicts a side view of the present invention.
Figure 5:
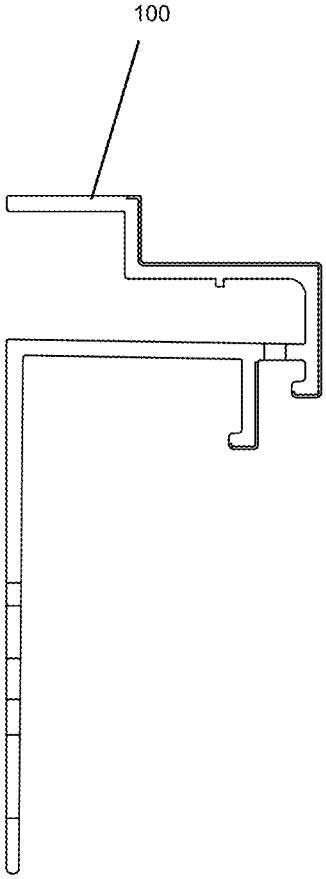
FIG. 5 depicts a side view of the present invention.
Figure 6:
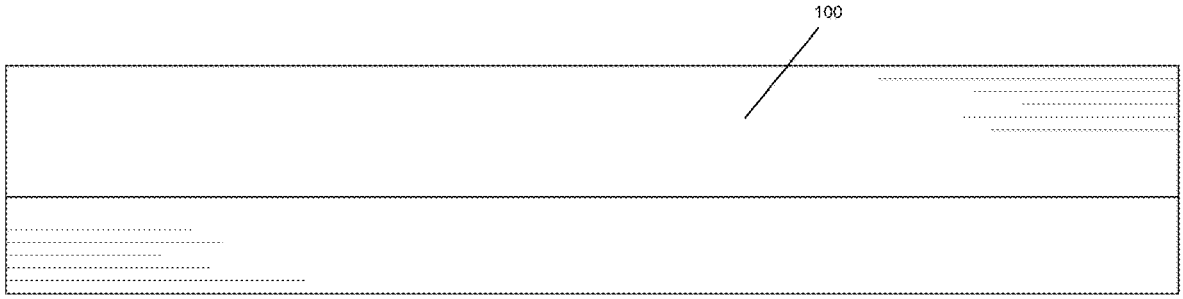
FIG. 6 depicts a top view of the present invention.
Figure 7:
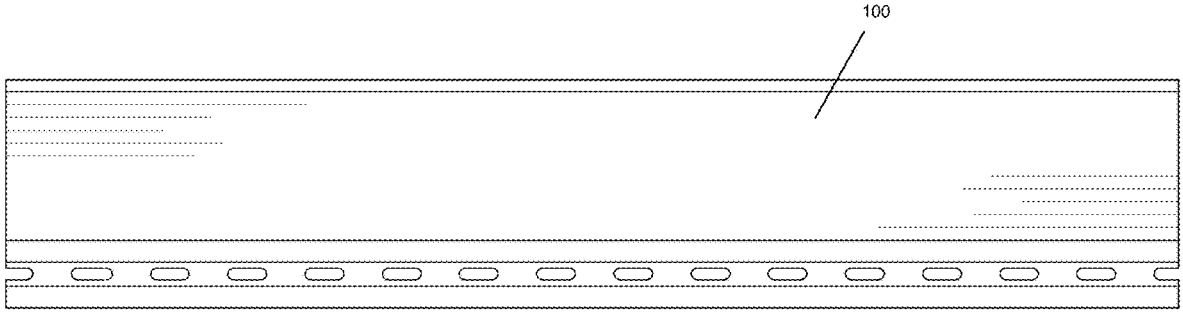
FIG. 7 depicts a bottom view of the present invention.

In the following detailed description, numerous specific details are set forth in order to provide a thorough understanding of the disclosure. However, it will be understood by those skilled in the art that the present disclosure may be practiced without these specific details. In other instances, well-known methods, procedures, components and layouts have not been described in detail so as not to obscure the present disclosure.

Reference throughout this specification to "one embodiment" or "an embodiment" means that a particular feature, structure, or characteristic described in connection with the embodiment is included in at least one embodiment of the present disclosure. Thus, the appearances of the phrases "in one embodiment" or "in an embodiment" or "according to one embodiment" (or other phrases having similar import) in various places throughout this specification are not necessarily all referring to the same embodiment. Furthermore, the particular features, structures, or characteristics may be combined in any suitable manner in one or more embodiments. Also, depending on the context of discussion herein, a singular term may include its plural forms and a plural term may include its singular form. Similarly, a hyphenated term may be occasionally interchangeably used with its non-hyphenated version, and a capitalized entry may be interchangeably used with its non-capitalized version. Such occasional interchangeable uses shall not be considered inconsistent with each other. It is noted that various figures (including component diagrams) shown and discussed herein are for illustrative purpose only, and are not drawn to scale.

The present invention has a drain/vent opening designed to maximize the Venturi effect by moving water vapor and air at a higher speed. The speed of the moisture moving through the drainage cavity is lower than the speed at the aperture/drain openings because the cross-sectional area at the drainage cavity is greater than that of the drain holes or apertures. Water appears in four forms and it moves from one form to another as it navigates its way within a wall. First, water in its different forms; solid, liquid, vapor and adsorbed, follows several basic rules of physics. Water runs downhill due to gravity. Second, air carrying water vapor moves from areas of higher air pressure to areas of lower air pressure. Third, water in the vapor form diffuses from warm to cold driven by the thermal gradient.

A primary drainage plane is not the complete solution for evaporation and drainage of moisture in walls. The key is air pressure from the outside of a structure and the temperature difference between the outside and inside of a structures' walls is how water gets into walls. This invention allows for the escape of water in different forms and with actual ventilation to dry the inside of the wall rather than relying on changes on air temperature allowing warm air to rise and cold air to sink.

It is not whether water or moisture forms or gets into the walls of a structure but, more significantly, when. Due to installation, design and the loading of a structure cracks appear and water or moisture enters without a means to escape. Once water or moisture is absorbed by the wall components such as the sheathing, mold and deterioration begin. Once signs of deterioration or odor appear the damage is already done and cannot be repaired without disassembling the wall.

Building codes require moisture barriers within walls. More frequently than not the barrier is penetrated by fasteners holding the building wrap or paper to the sheathing and these fastener holes are a means for moisture to enter a wall. Traditional weep screeds, j-metal and or casing beads, even when punched with holes, do not allow the effective escape of water or moisture from the wall. Once the stucco is applied to the substrate any such punched holes are often sealed. With traditional weep screeds the initial shrinkage of stucco as it dries pulls back from the screed allowing a minute space for vapor to slowly escape. As water moves from form to form the passage of moisture is greatly reduced.

With reference to FIGS. 1-9, the present invention provides a ventilation screed (100) comprising: a perforated attachment flange portion (102) that is substantially vertical and has a top end (104) and a bottom end (106) and at least one perforation (108) between the top end (104) and the bottom end (106); a first substantially horizontal flange portion (110) having a first end (112) and a second end (114) and attached to the top end (104) of the perforated attachment flange at the first end (112); a first vertical flange portion (116) having a top end (118), a bottom end (120) and a mid-section (122) and is attached at a point along a mid-section to the second end (114) of the first substantially horizontal flange portion (110) and having a first return leg (124); a second vertical flange portion (126) attached to the underside of the first substantially horizontal flange portion (110) along a mid-section and having a second return leg (128); a stepped flange portion (130) attached to the top end (118) of the first vertical flange portion (118) and having a first substantially horizontal portion (132), a substantially vertical portion (134) and a second substantially horizontal portion (136) that is parallel to first substantially horizontal flange portion (110); at least two drain vent openings (138) in the first substantially horizontal flange portion (110) between the first return leg (124) and the second return leg (128). There may also be a friction bead along a bottom side of the first vertical flange portion (132) of the stepped flange portion (130). The friction bead may also act as a stop to hold the connector in place. The bead may be made of resilient material and allow movement with changes in temperature or air pressure to minimize cracking or other damage to the cladding, such as stucco or cementitious fiber board, it stops or terminates. The term midsection refers to the section in the middle of a portion between two ends or sides. It is an area that is not encompassed by the ends or sides of a portion, but is between two ends or sides of a portion. The first substantially horizontal flange portion (110) may be at an angle between 83 and 90 degrees to enable water and vapor to be gravity driven toward the at least two drain vent openings (138).

FIG. 1 provides an example of the perforations (108) of the perforated attachment flange portion is two rows of triangular openings (105 and 107). As can be seen the triangular openings are alternating large and small triangles which also alternate in their orientation. The large triangle has the peak at the bottom and the small triangle has the peak at the top. This could also be reversed (the large triangle having the peak at the top and the small triangle having the peak at the bottom). There may also be at least one row of circular openings (109). The circular openings (109) may be used to attach the ventilation screed (100) by a nail or fastener being driven through the circular opening (109) and into the underlying surface.

Figure 8:
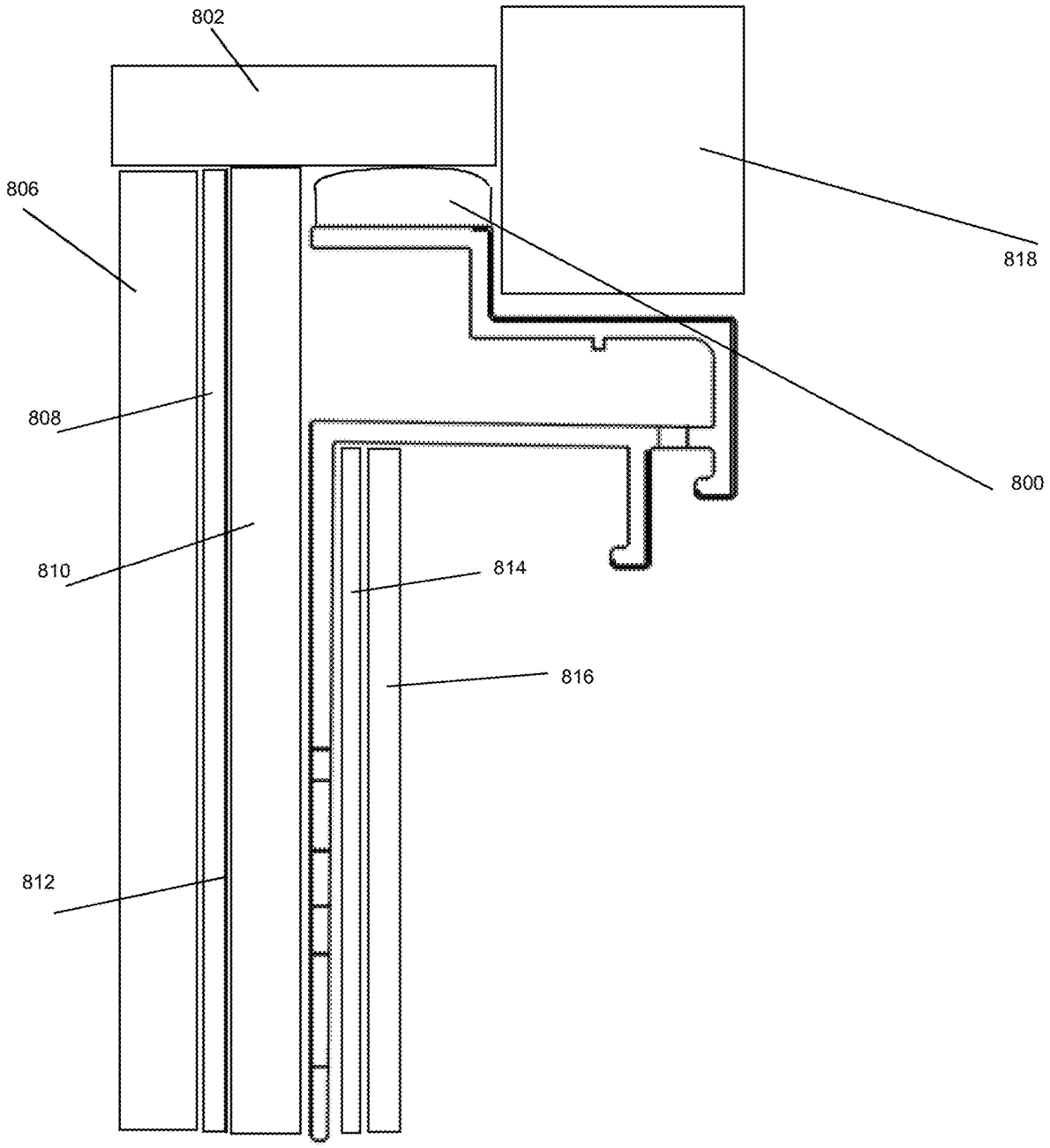
FIG. 8 depicts the present invention in a sample environment as it may be installed.
Figure 9:
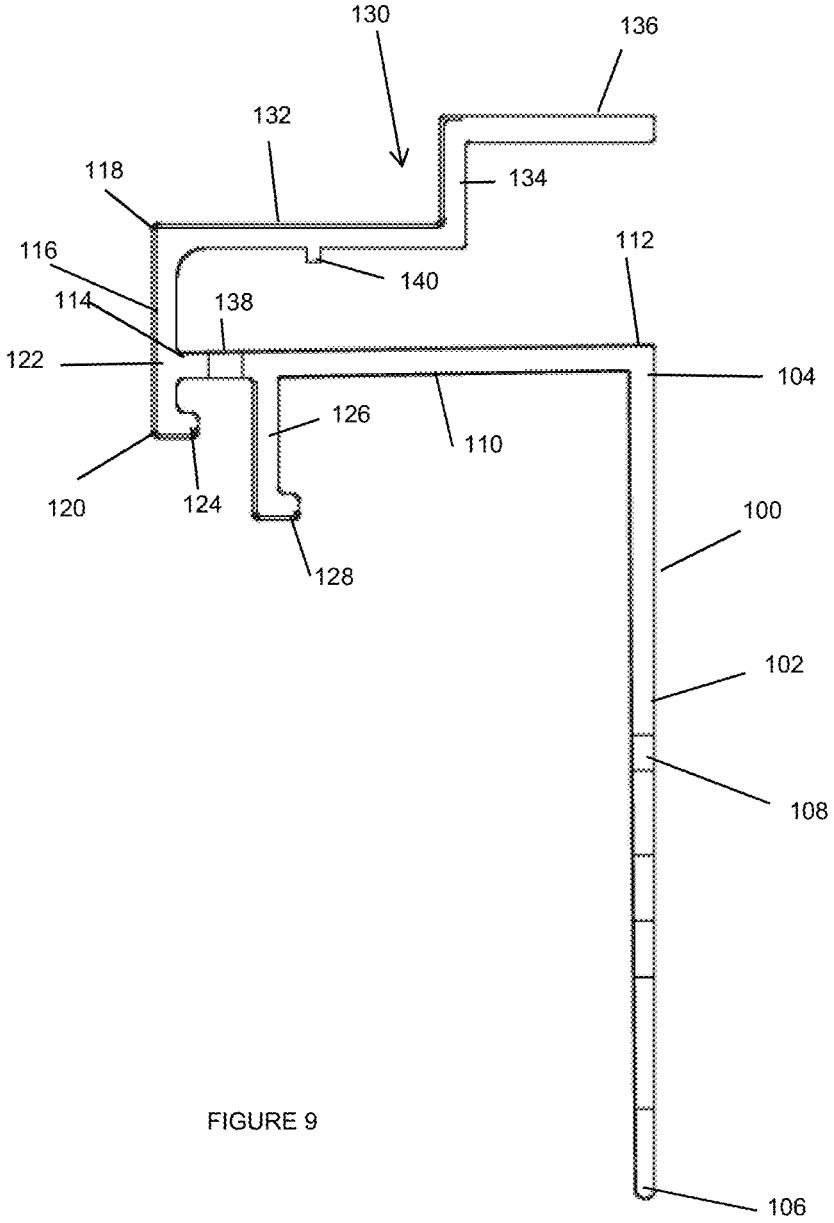
FIG. 9 depicts a side view of the present invention.
Figure 10:
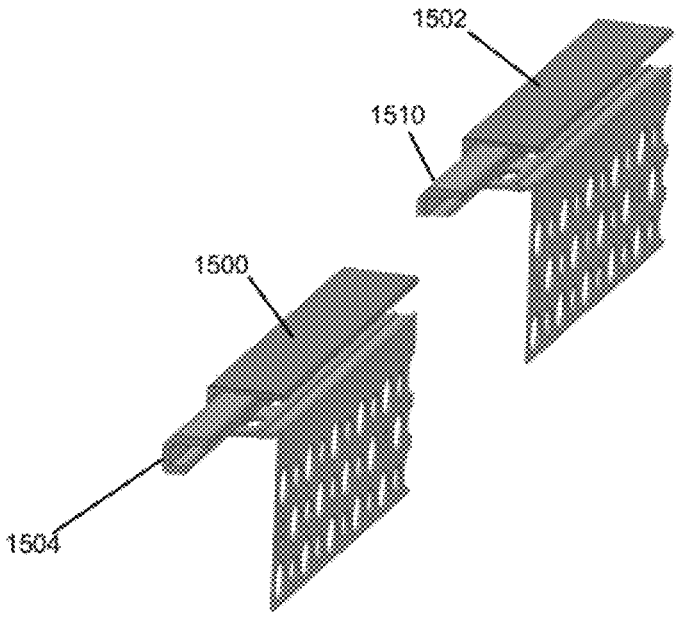
FIG. 10 depicts two ventilation screeds with a connector between them.

As shown in FIG. 8, a gasket (800) is under a soffit (802), the ventilation screed (804) is under the gasket (800). The gasket may also be referred to as a moisture seal or water seal. The environment as installed may have a sheathing (806), building wrap (808), reticulated foam (810) or "AMICO Greenscreen®," grade D paper (812), lath (814) and stucco or siding (816 and 818). The reticulated foam (810) could also be an insect screen, it could be an unwoven polymer such as cellulose, nylon or spun polypropylene fiber, or it could be even a nylon or polypropylene screen, although that would be less durable. There may be AMICO Greenscreen®, or another rain screen or solid or corrugated furring strips to the right of the ventilation screed (804), then lath and brick or stone veneer. The AMICO Greenscreen®, or another rain screen or solid or corrugated furring strips may be installed parallel to and between siding and the perforated attachment flange portion (820). There may also be a screen vertical and perpendicular to at least a portion of the perforated attachment flange portion. There may also, or alternatively, be a mesh vertical and perpendicular to at least a portion of the perforated attachment flange portion. There may also be reticulated foam (which may be in the same location as the rain screen or solid or corrugated furring strips) to the right of the ventilation screed, then lath and brick or stone veneer. The reticulated foam insert may be installed parallel to the siding. The AMICO "Greenscreen®" refers to a brand of polypropylene entangled mesh, but it could also be a polymer strand matrix with a dimple structure. The AMICO Greenscreen® provides a drainage path and ventilation for moisture between the exterior wall finish and sheathing. It is a polymer strand matrix with a unique dimple design that exhibits superior compressive strength. When installed according to the present invention is allows over 99% of moisture and vapor to drain and escape from the wall. There may also be a screen parallel to at least a portion of the perforated attachment flange portion. There may also, or alternatively, be a mesh parallel to at least a portion of the perforated attachment flange portion. A shown, in FIG. 8, there may be a ventilation screed (804) with a moisture seal that is a gasket (800) between the ventilation screed (804) and a soffit (802) of a building. The optional "gasket" is provided to assist in getting a superior, and depending on the design of the gasket moveable, moisture barrier at the juncture of vertical and horizontal surfaces such as a soffit, or between the finish and a window or door jamb or whatever through wall penetration is required, such as but not limited to hose bib or louvered vent or vent shroud. The first substantially horizontal portion and the substantially vertical portion of the stepped flange portion are sized to receive a thickness of finish (818). For example, the finish (818) may be a piece of siding that is sized to be received in the stepped flange portion as depicted in FIG. 8 to be substantially in-line with the first vertical flange portion (116). FIG. 10 depicts that there may be a connector (1510) between two adjacent ventilation screeds (1500 and 1502). The connector (1510) allows for easy installation and ensures that the installation is even and co-planar. FIG. 10 also depicts that another connector (1504) may be used. Any number of ventilation screeds may be connected using any desired number of connectors.

Figure 11:
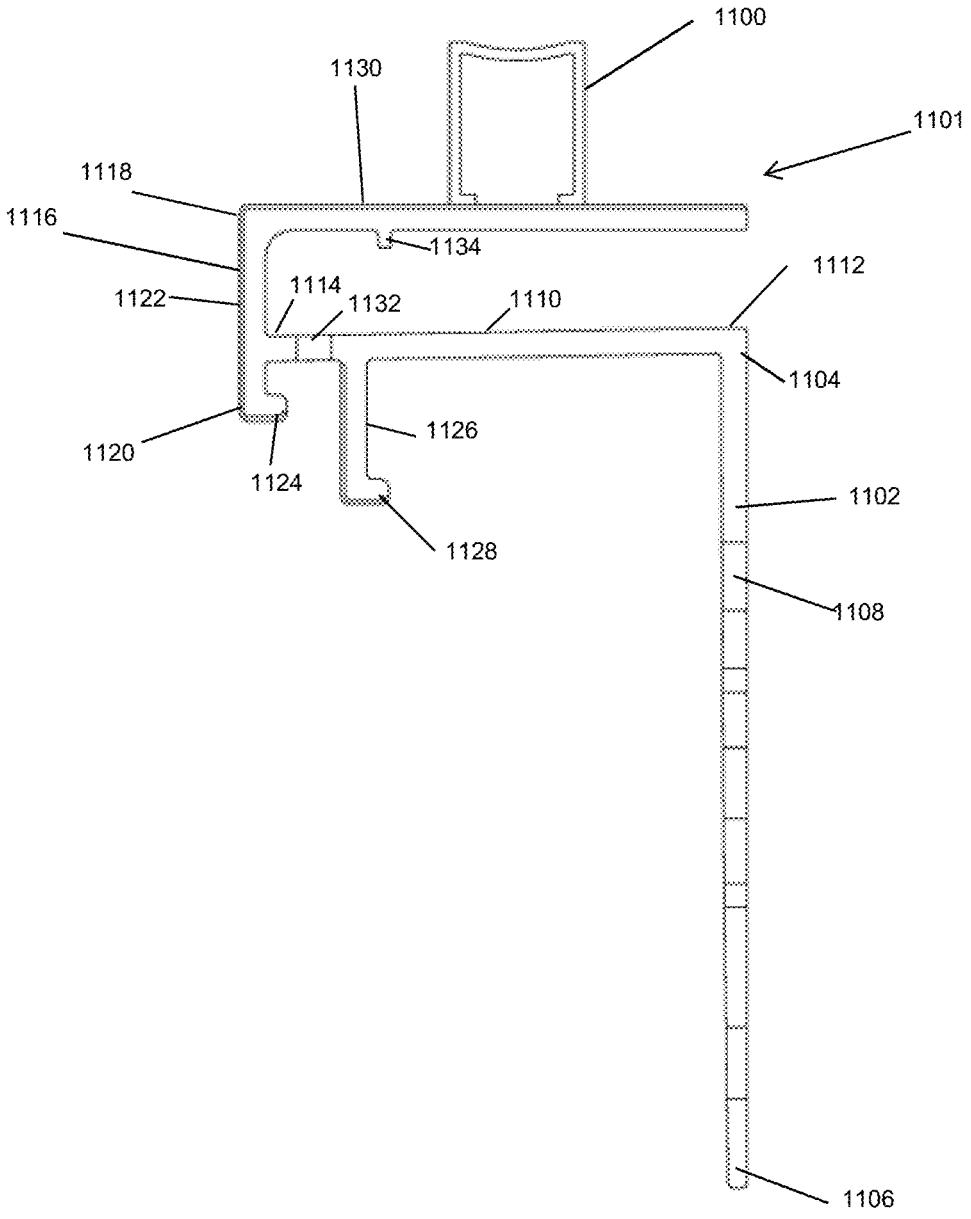
FIG. 11 depicts a ventilation screed with a water seal.

FIG. 11 depicts another embodiment that does not have a stepped flange portion attached to the top end of the first vertical flange portion, instead having a water seal at the middle of a top of the second substantially horizontal flange portion. This may act similarly to the stepped flange. As can be seen in FIG. 11, there is a ventilation screed (1101) comprising: a perforated attachment flange portion (1102) that is substantially vertical and has a top end (1104) and a bottom end (1106) and at least one perforation (1108) between the top end (1104) and the bottom end (1106); a first substantially horizontal flange portion (1110) having a first end (1112) and a second end (1114) and attached to the top end (1104) of the perforated attachment flange at the first end (1112); a first vertical flange portion (1116) having a top end (1118), a bottom end (1120) and a mid-section (1122) and attached at a point along a mid-section to the second end (1114) of the first substantially horizontal flange portion and having a first return leg (1124); a second vertical flange portion (1126) attached to the underside of the first substantially horizontal flange portion along a mid-section and having a second return leg (1128); a second substantially horizontal flange portion (1130) attached to the top end (1118) of the first vertical flange portion and substantially parallel to the first substantially horizontal flange portion; at least two drain vent openings (1132) in the first substantially horizontal flange portion between the first return leg (1124) and the second return leg (1128); and a water seal (1100) at the middle of a top of the second substantially horizontal flange portion (1130). As depicted and discussed previously, the at least one perforation of the perforated attachment flange portion may have two rows of triangular openings. There may also be at least one row of circular openings. The two rows of triangular openings may be alternating large and small triangles. The first substantially horizontal flange portion may be at an angle between 83 and 90 degrees to enable water and vapor to be gravity driven toward the at least two drain vent openings. There may also be a connector between two adjacent ventilation screeds. There may also be a friction bead (1134) along a bottom side of the second substantially horizontal flange portion (1130). The present embodiment provides an improved top of wall termination of cladding that provides a grounding surface for and not limited to cementitious stucco finishes as well as a method for venting water vapor from within exterior walls. In its most general interpretation this invention for the termination of finish and ventilation of walls includes an integral nailing flange with or without holes or any shapes forming a plurality of differing size and shaped openings. These openings allow for mechanical fasteners or adhesives. Extending outward from the nailing flange is an integral plaster stop achieving the function of casing bead thus setting the depth or thickness of stucco finish. This invention is designed to act as both a vent and drain. Drain/vent apertures are located in the horizontal surface. In all embodiments of the invention, the size and shape of the venting mechanism apertures can vary with the application of the device. The angle of the ground flange is less than 90 degrees allowing enhanced drainage by gravity.

In one embodiment, deflector surface/nubs are positioned adjacent to the opening of the drain/vent hole which works to shroud the drain/vent opening from wind driven or sprinkler water backflow into the internal vapor/drainage cavity. An extended nub running the length of the invention closest to the attachment flange acts to terminate the stucco finish. Drainage and venting mechanism is defined by the vapor drainage cavity; apertures of the drainage vent surface running the length of the invention; cavity buttress (a term used to define the exposed front flange opposite the rear opening in the drainage cavity); extended grounding nub. Further embodiments of this invention allow for most any cladding material to be incorporated into this ventilated wall invention, including but not limited to stucco, veneer stone, cement board siding, metal siding, and insulated metal siding. This ventilation screed according to the present invention may be factory fitted to accept any thickness of finish material, including but not limited to stucco, veneer stone or cement siding. The present embodiment provides an improvement over current art since current production capabilities and processes cannot easily extrude and punch holes. Traditional casing bead, plaster stop creates a moisture problem since vapor cannot escape the top of the wall. This condition is a direct cause of moisture induced problems, mold and deterioration, in areas below in the stucco panel. Traditional installation practices and building codes require layer(s) of water resistant barrier, WRB over framed and sheathed walls upon which a lath material, stucco substrate, and specified layers or thicknesses of cementitious finish materials would be applied.

As the invention has been described, it will be apparent to those skilled in the art that the same may be varied in many ways without departing from the spirit and scope of the invention. Any and all such modifications are intended to be included within the scope of the appended claims.

In the preceding description, for purposes of explanation and not limitation, specific details are set forth (such as particular structures, components, techniques, etc.) in order to provide a thorough understanding of the disclosed fencing system. However, it will be apparent to those skilled in the art that the disclosed system may be constructed in other embodiments that depart from these specific details. That is, those skilled in the art will be able to devise various arrangements which, although not explicitly described or shown herein, embody the principles of the disclosed system. In some instances, detailed descriptions of well-known components and construction methods are omitted so as not to obscure the description of the disclosed system with unnecessary detail. All statements herein reciting principles, aspects, and embodiments of the disclosed system, as well as specific examples thereof, are intended to encompass both structural and functional equivalents thereof. Additionally, it is intended that such equivalents include both currently known equivalents as well as equivalents developed in the future, such as, for example, any elements developed that perform the same function, regardless of structure.

As will be recognized by those skilled in the art, the innovative concepts described in the present application can be modified and varied over a wide range of applications. Accordingly, the scope of patented subject matter should not be limited to any of the specific exemplary teachings discussed above, but is instead defined by the following claims.

The invention claimed is:

1. A ventilation screed comprising:

a perforated attachment flange portion that is substantially vertical and has a top end and a bottom end and at least one perforation between the top end and the bottom end;

a first substantially horizontal flange portion having a first end and a second end and attached to the top end of the perforated attachment flange at the first end;

a first vertical flange portion having a top end, a bottom end and a mid-section and attached at a point along a mid-section to the second end of the first substantially horizontal flange portion and having a first return leg;

a second vertical flange portion attached to the underside of the first substantially horizontal flange portion along a mid-section and having a second return leg;

a stepped flange portion attached to the top end of the first vertical flange portion and having a first substantially horizontal portion, a substantially vertical portion and a second substantially horizontal portion that is parallel to first substantially horizontal flange portion;

at least two drain vent openings in the first substantially horizontal flange portion between the first return leg and the second return leg.

2. A ventilation screed as in claim 1, wherein the at least one perforation of the perforated attachment flange portion is two rows of triangular openings.

3. A ventilation screed as in claim 1, wherein the at least one perforation of the perforated attachment flange portion further comprises at least one row of circular openings.

4. A ventilation screed as in claim 2, wherein the two rows of triangular openings are alternating triangles of a first size and a second size.

5. A ventilation screed as in claim 1, wherein the first substantially horizontal flange portion is at an angle to enable water and vapor to be gravity driven toward the at least two drain vent openings.

6. A ventilation screed as in claim 1, wherein the first substantially horizontal portion and the substantially vertical portion of the stepped flange portion are sized to receive a thickness of finish.

7. A ventilation screed as in claim 1, further comprising a connector and two adjacent ventilation screeds, wherein the connector is between the two adjacent ventilation screeds.

8. A ventilation screed as in claim 1, further comprising a screen parallel to at least a portion of the perforated attachment flange portion.

9. A ventilation screed as in claim 1, further comprising a mesh parallel to at least a portion of the perforated attachment flange portion.

10. A ventilation screed as in claim 1, further comprising a reticulated foam insert that installed is parallel to and between a wall and the perforated attachment flange portion.

11. A ventilation screed as in claim 1, further comprising a water seal along a top portion of the second substantially horizontal portion of the stepped flange portion.

12. A ventilation screed as in claim 1, further comprising a friction bead along a bottom side of the first vertical flange portion of the stepped flange portion.

13. A ventilation screed comprising:

a perforated attachment flange portion that is substantially vertical and has a top end and a bottom end and at least one perforation between the top end and the bottom end;

a first substantially horizontal flange portion having a first end and a second end and attached to the top end of the perforated attachment flange at the first end;

a first vertical flange portion having a top end, a bottom end and a mid-section and attached at a point along a mid-section to the second end of the first substantially horizontal flange portion and having a first return leg;

a second vertical flange portion attached to the underside of the first substantially horizontal flange portion along a mid-section and having a second return leg;

a second substantially horizontal flange portion attached to the top end of the first vertical flange portion and substantially parallel to the first substantially horizontal flange portion;

at least two drain vent openings in the first substantially horizontal flange portion between the first return leg and the second return leg; and a water seal at the middle of a top of the second substantially horizontal flange portion.

14. A ventilation screed as in claim 13, wherein the at least one perforation of the perforated attachment flange portion is two rows of triangular openings.

15. A ventilation screed as in claim 13, wherein the at least one perforation of the perforated attachment flange portion further comprises at least one row of circular openings.

16. A ventilation screed as in claim 14, wherein the two rows of triangular openings are alternating triangles of a first size and a second size.

17. A ventilation screed as in claim 13, wherein the first substantially horizontal flange portion is at an angle to enable water and vapor to be gravity driven toward the at least two drain vent openings.

18. A ventilation screed as in claim 1, further comprising a connector and two adjacent ventilation screeds, wherein the connector is between the two adjacent ventilation screeds.

19. A ventilation screed as in claim 1, further comprising a friction bead along a bottom side of the second substantially horizontal flange portion.

* * * * *